US005209624A

United States Patent [19]

Nicolaisen

[11] Patent Number: 5,209,624

[45] Date of Patent: May 11, 1993

[54] METHOD OF INTERCONNECTING TWO SHEETS OR PLATES, ESPECIALLY A METHOD OF COVERING A BOOK

[75] Inventor: Soren K. Nicolaisen, Holbak, Denmark

[73] Assignee: CREA TO ApS, Copenhagen, Denmark

[21] Appl. No.: 721,628

[22] PCT Filed: Jan. 15, 1990

[86] PCT No.: PCT/DK90/00012

§ 371 Date: Jul. 18, 1991

§ 102(e) Date: Jul. 18, 1991

[87] PCT Pub. No.: WO90/08044

PCT Pub. Date: Jul. 26, 1990

[30] Foreign Application Priority Data

Jan. 13, 1989 [DK] Denmark ..... 162/89

[51] Int. Cl.[5] ..... B42C 11/00; B42D 1/00

[52] U.S. Cl. ..... 412/4; 281/29; 281/34; 283/36

[58] Field of Search ..... 281/29, 34, 36; 283/36; 412/4

[56] References Cited

U.S. PATENT DOCUMENTS

| | | | |
|---|---|---|---|
| 3,038,742 | 6/1962 | Leap | 281/29 |
| 3,133,750 | 5/1964 | Gerald | 281/34 |
| 3,334,919 | 8/1967 | Crawford | 281/29 |
| 3,749,422 | 7/1973 | Abildgaard et al. | 281/29 X |
| 3,825,963 | 7/1974 | Abildgaard et al. | 412/21 |
| 3,904,227 | 9/1975 | Sendor | 281/29 |
| 3,912,304 | 10/1975 | Abildgaard et al. | 281/29 X |
| 3,915,778 | 10/1975 | Carter et al. | 281/34 X |
| 3,964,770 | 6/1976 | Abildgaard et al. | 281/29 |
| 4,422,672 | 12/1983 | Levi | 281/38 X |
| 4,511,298 | 4/1985 | Jones | 412/34 |
| 4,793,758 | 12/1988 | Hanson et al. | 281/29 X |
| 4,893,979 | 1/1990 | Alpers | 281/29 X |

FOREIGN PATENT DOCUMENTS

| | | | |
|---|---|---|---|
| 296223 | 2/1972 | Austria . | |
| 426928 | 5/1975 | Sweden . | |
| 264313 | 1/1950 | Switzerland . | |
| 1480954 | 7/1977 | United Kingdom | 281/29 |
| 2071569 | 9/1981 | United Kingdom | 281/29 |

OTHER PUBLICATIONS

Patent Cooperation Treat International-type Search Report, dated Aug. 16, 1989.

*Primary Examiner*—Paul A. Bell

*Attorney, Agent, or Firm*—Merchant, Gould, Smith, Edell, Welter & Schmidt

[57] ABSTRACT

A sheet or plate (10) for use for example as a stiffening plate for a book cover comprises an adhesive layer (12) applied to a narrow zone extending along and adjacent to at least one end of the plate or sheet. The adhesive layer (12) is covered by a protective peel-off strip (13) having a free end portion (15). This free end portion is folded along a folding line (16), which defines an acute angle with the longitudinal axis of the protective strip, whereby the free end portion of the protective strip extends beyond said edge of the sheet so as to define an accessible gripping end. The plate or sheet (10) may be arranged and retained in abutting engagement with a second sheet or plate (21), such as a book cover. Now, the protective strip (13) may be removed by pulling the free end portion (15), whereby the sheets or plates may be interconnected.

19 Claims, 1 Drawing Sheet

Figure 1:
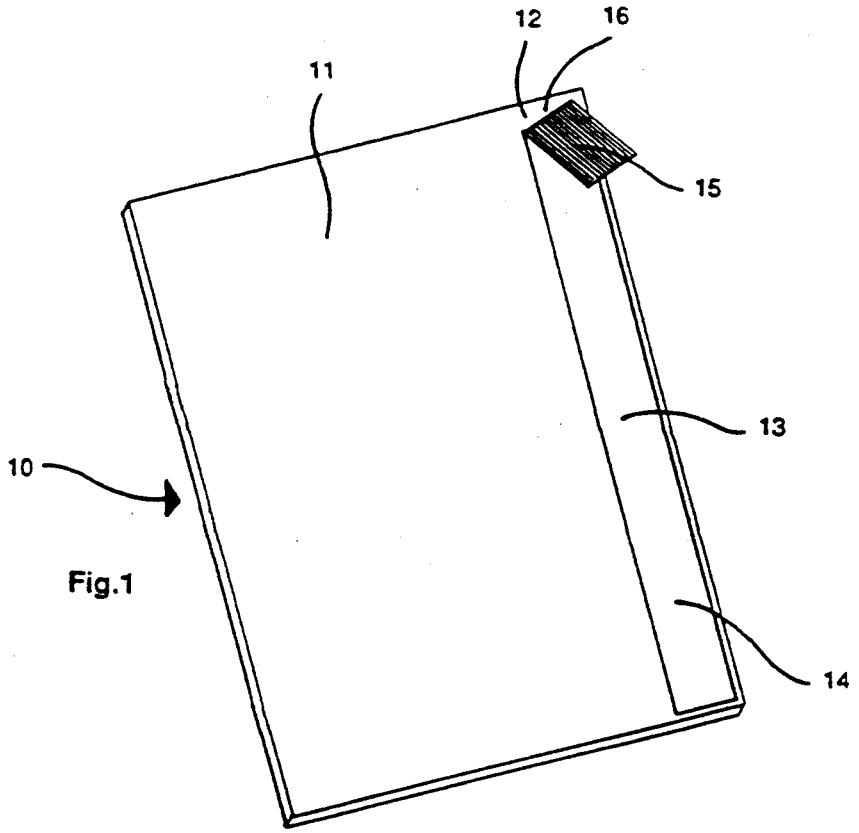

METHOD OF INTERCONNECTING TWO SHEETS OR PLATES, ESPECIALLY A METHOD OF COVERING A BOOK

The present invention relates to a method of interconnecting a first sheet or plate and a second sheet or plate in face to face relationship, especially a method of covering books, such as paperback books.

Within the field of covering paperback books (the term paperback book should in this specification be understood in its broadest sense comprising also telephone books and any printed matter provided with a relatively soft cover) various solutions have been proposed for protecting such books and for enabling the placing of the books in a shelf in an upright position. As an example GB Patent No. 1,480,954 discloses a cover for a book, such as a paperback book, comprising a front cover panel and a back cover panel hingedly connected one to each of the longitudinal edges of an intermediate panel or spine, and an adhesive located in strips adjacent to each of the free edges of the inside faces of said front and back cover panels, the adhesive being covered by a release paper or the like. The book cover according to this patent specification involves a number of drawbacks. The cover is relatively complicated to manufacture and therefore relatively expensive, and the covering operation is difficult to perform, as when the release paper has been removed, and the book and the cover has been brought into mutual engagement, the book will instantly adhere to the adhesive strip, so that a later correction of the alignment of book and cover will not be possible. Furthermore, it is necessary to use different sizes of covers for books of the same format having different thicknesses. An attempt to overcome the problem of using different sizes of covers for books with different thicknesses has been made in U.S. Pat. No. 3,133,750, but the three-part book cover according to that specification is also of a relatively complicated structure, and it is difficult to mount the cover in correct alignment with the book.

U.S. Pat. No. 3,825,963 discloses a method of casing books. In this known method an adhesive layer is applied to substantially the total area of one side surface of one of the sheets to be interconnected, and a sheet of release paper covering the adhesive layer is folded and laid double so that the fold extends along one end of the sheet to which the adhesive is applied, while a free end portion of the release sheet extends beyond the opposite edge of the sheet. The sheets to be interconnected are placed in abutting engagement with the double layer of the release sheet therebetween. Thereafter, the release sheet is removed by exerting a pulling force to the exposed free end of the release sheet. The pulling force necessary to remove the release sheet is rather high, and, therefore, it is normally not possible to remove the release sheet manually without using mechanical means.

The present invention provides an improved method of the above type, said method comprising applying a layer of adhesive to a surface of said first sheet or plate, covering the adhesive layer with a protective peel-off strip, folding a free end portion of the protective strip along a folding line, placing a surface of the second plate or sheet in engagement with the first plate or sheet in a predetermined relationship in which said layer of adhesive is at least partly covered by the second layer or sheet, maintaining the predetermined relationship of said plates or sheets by pressing the first and second plates or sheets into tight mutual engagement, and pulling the folded free end portion of the protective strip so as to remove the protective strip from the adhesive layer while maintaining the close mutual engagement of the plates or sheets, and the method according to the invention is characterized in that said adhesive layer is applied to a narrow zone extending along and adjacent to at least one edge of the first plate or sheet, and that the free end portion of the protective strip is folded so that the folding line defines an acute angle with the longitudinal axis of the protective strip, whereby the free end portion of the protective strip extends beyond said edge of the first sheet so as to define an accessible gripping end. Because the folded end portion of the peel-off strip is sandwished between and in engagement with only a relatively small area of the plates or sheets to be interconnected, the peel-off strip may be removed manually without using special mechanical devices. The adhesive layer may be applied to a zone extending along only one edge of the first plate or sheet. However, the adhesive layer may be applied to zones extending along two or more edges of the preferably rectangular first plate or sheet.

In a preferred embodiment of the first plate or sheet the acute angle defined between the folding line and the longitudinal axis of the protective strip exceeds 45°, and the angle is preferably between 55° and 80°, providing for a gripping end portion of sufficient size with a minimum length of the free end portion, and a low risk of destroying the protective strip during the peel-off operation.

The adhesive for forming the adhesive layer can be a pressure sensitive adhesive, an instant hardening adhesive or an adhesive with a somewhat retarded hardening. Thus, acrylic adhesives or rubberbased adhesives may be used.

When using the method according to the invention for stiffening and/or covering a book the first sheet or plate is preferably a stiff or rigid cardboard or millboard plate, but obviously a plates of stiff or rigid plastics or other relatively stiff or rigid materials may be used. The faces of said first and second sheets or plates have substantially the same size, and the book and the cover may be put into alignment prior to removal of the protective strip to ensure a correct covering of the book.

The invention also relates to a sheet or plate for use in carrying out the method described above and comprising an adhesive layer applied to a surface part thereof, said adhesive layer being covered by a protective peel-off strip having a free end portion folded along a folding line, and the method according to the invention is characterized in that the surface part to which the adhesive layer is applied is a narrow zone extending along and adjacent to at least one edge of said sheet, and that said folding line defines an acute angle with the longitudinal axis of the protective strip, whereby the free end portion of the protective strip extends beyond said edge of the sheet so as to define an accessible gripping end.

Such plate or sheet is especially applicable as a book cover for a paperback book. When plates of the above kind are applied to the front and the back of a book, the book can be placed in a shelf in an upright position, and as it is not necessary to provide the book with a spine cover. The text on the spine can still be read. Furthermore, it is possible to change the visual appearance of the book. For instance, the cover according to the invention may be decorated or stamped with the name of the owner of the book.

The invention will now be further described referring to the drawings, in which

Figure 2:
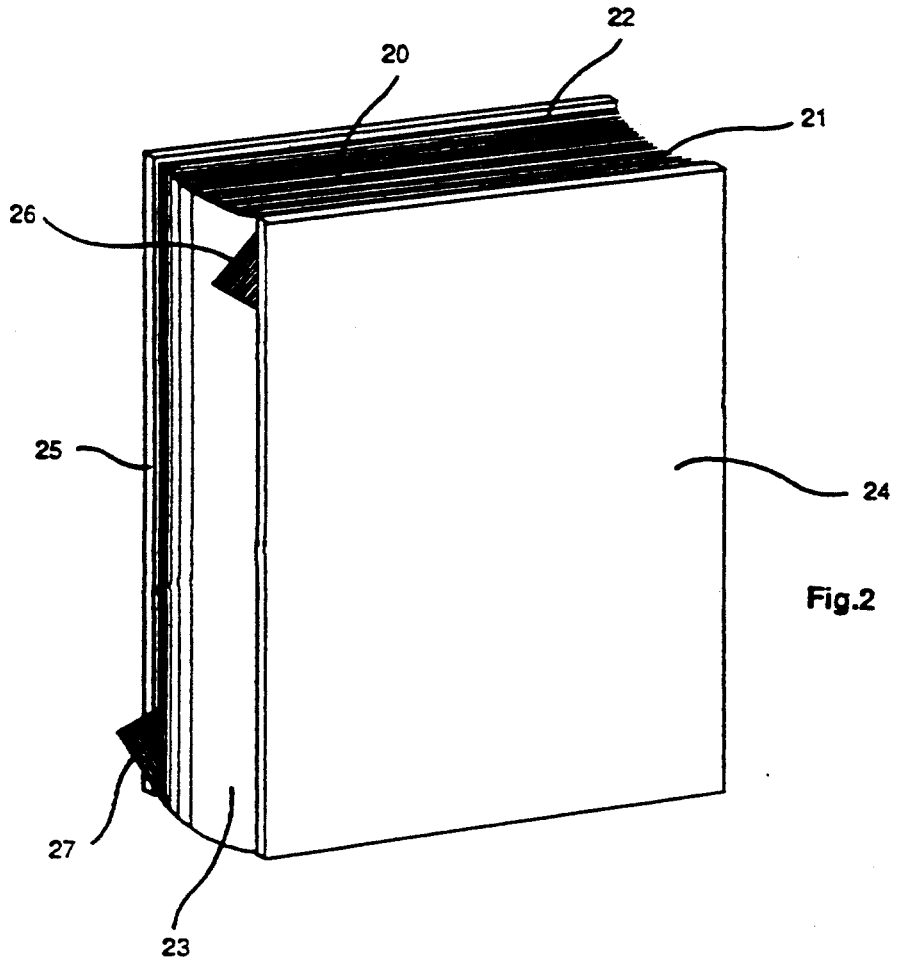

FIG. 1 is a perspective view of a preferred embodiment of a plate according to the present invention for covering a book, and FIG. 2 is a perspective view of a book, a pair of plates according to the present invention being positioned in engagement with the front and the back of the book.

FIG. 1 shows a millboard plate 10 for covering a book. On the surface 11 is applied an adhesive layer 12 which is covered by (and hidden behind) a protective peel-off strip 13 of paper. The protective strip 13 comprises a protective part 14 and a free end 15. The free end 15 is folded back and a fold 16 is formed between the free end 15 and the protective part 14. The fold 16 forms an acute angle of around 70° with the longitudinal axis of the protective part 14 of the protective strip 13.

FIG. 2 shows a paperback book 20 comprising a front 21, a back 22 and a spine 23. Identical front cover and a back cover plates 24 and 25 according to the invention are put into contact with the respective front 21 and back 22 of the book 20 and brought into alignment therewith. A gripping end 26 of a peel-off strip of the front cover plate 24 extends rearwardly from the arrangement enabling a person to catch hold of said end 26 and pull it off in a downward direction. A similar gripping end 27 extends from the back cover plate 25 so that the peel-off strip can be removed in an upward direction.

When the book 20 is to be covered with the covering plates 24 and 25, the book 20 and the plates 24 and 25 are aligned in the same way as a pack of cards. The correct alignment and a tight engagement is maintained by pressing the front and back cover plates 24 and 25 against the book 20 with one hand. Concurrently, the other hand is used for catching hold of the gripping end 26, and said end is pulled in a downward direction, substantially in a direction inclined in relation to the fold of the peel-off strip along the spine 23 of the book 20, whereby the peel-off strip is removed as the fold of the strip travels along the adhesive layer and the front cover 24 is gradually adhered to the front 21 of the book 20. While the engagement pressure with one hand is still maintained the peel-off strip of the back cover 25 is removed by pulling the gripping end 27 in an upward direction, substantially in a direction inclined in relation to the fold of the peel-off strip, and the back cover 25 is similarly adhered to the back 22 of the book.

It is obvious that the principles of the invention can be used in many different applications. For example, the concept according to the invention of folding a protective peel-off strip may be used for facilitating the correct mounting of stickers, posters or streamers to a substrate.

Furthermore, the invention may be subject to various modifications. The sheets or plates to be interconnected may both comprise a layer of protected adhesive, such as a two-component adhesive. The sheet or plate to be used as book cover may be of a transparent plastics material, so as to retain the original visual appearance of the book. Similarly, the protective strip may be of any other suited material, such as plastic or fabric.

I claim:

1. A sheet for interconnecting with a sheet member in a face to face relationship, comprising:

a sheet having a front and back face, a top edge, a bottom edge, and first and second side edges;

an adhesive layer applied to a narrow side surface zone on the back face of the sheet extending along and adjacent to the first side edge thereof;

a protective peel-off strip covering the adhesive layer, the protective strip having a longitudinal axis and extending beyond at least the top edge of the sheet to form a free end portion thereof, the free end portion of the protective strip being folded along a fold line defining an acute angle with the longitudinal axis so that the free end portion extends beyond the first side edges of the sheet to define an accessible gripping end whereby the sheet may be adhered to the sheet member by arranging the sheet and sheet member such that the protective strip is located therebetween and the protective strip is remove by pulling the gripping end of the protective strip to expose the adhesive.

2. The sheet of claim 1 wherein the acute angle exceeds 45°.

3. The sheet of claim 1 wherein the acute angle is between 55° and 80°.

4. The sheet of claim 1 wherein the adhesive is a pressure sensitive adhesive.

5. The sheet of claim 1 wherein the first sheet is a rigid paperboard plate for stiffening the second sheet.

6. The sheet of claim 1 wherein the adhesive is an instant hardening adhesive.

7. The sheet of claim 1 wherein the adhesive is a slow hardening adhesive.

8. The sheet of claim 7 wherein the adhesive is an acrylic adhesive.

9. The sheet of claim 7 wherein the adhesive is rubber-based.

10. A method for interconnecting first and second sheets in a face to face relationship, the sheets having a front and back face, a top edge, a bottom edge, and first and second side edges, comprising the steps of:

a) applying an adhesive layer to a narrow side surface zone on the back face of the first sheet extending along and adjacent to the first side edge thereof;

b) covering the adhesive layer with a protective peel-off strip extending beyond at least the top edge of the first sheet to form a free end portion thereof, the protective strip having a longitudinal axis;

c) folding the free end portion of the protective strip along a fold line defining an acute angle with the longitudinal axis so that the free end portion extends beyond the first side edges of the sheet to define an accessible gripping end;

d) positioning the first and second sheets into a predetermined relationship so that at least part of the protective strip is located between the back faces of the first and second sheet;

e) pressing the first and second sheets into a tight mutual engagement at a location distinct from the adhesive strip; and f) pulling the free end portion of the protective strip so as to remove the protective strip from its position between the first and second sheets while maintaining the mutual engagement therebetween, so that the first and second sheets are interconnected by the adhesive layer.

11. The method of claim 10 wherein the acute angle exceeds 45°.

12. The method of claim 10 wherein the acute angle is between 55° and 80°.

13. The method of claim 10 wherein the adhesive is a pressure sensitive adhesive.

14. The method of claim 10 wherein the first sheet is a rigid paperboard plate for stiffening the second sheet.

15. The method of claim 14 wherein the second sheet is part of a book cover.

16. The method of claim 10 wherein the adhesive is an instant hardening adhesive.

17. The method of claim 10 wherein the adhesive is a slow hardening adhesive.

18. The method of claim 17 wherein the adhesive is an acrylic adhesive.

19. The method of claim 17 wherein the adhesive is rubber-based.

* * * * *

UNITED STATES PATENT AND TRADEMARK OFFICE

CERTIFICATE OF CORRECTION

PATENT NO. : 5,209,624

DATED : May 11, 1993

INVENTOR(S) : Soren K. Nicolaisen

It is certified that error appears in the above-indentified patent and that said Letters Patent is hereby corrected as shown below:

On title page, item [75] delete "Holbak," and insert --Holbæk,--.

Signed and Sealed this

Fifth Day of July, 1994

Bruce Lehman

*Attest:*

BRUCE LEHMAN

*Attesting Officer*

*Commissioner of Patents and Trademarks*